United States Patent [19]

Landwerlen

[11] 4,125,236

[45] Nov. 14, 1978

[54] TRANSOM SAVER

[76] Inventor: Joseph E. Landwerlen, 728 1st St., Shelbyville, Ind. 46176

[21] Appl. No.: 795,792

[22] Filed: May 11, 1977

[51] Int. Cl.[2] ..... B63H 5/12

[52] U.S. Cl. ..... 248/4; 115/17

[58] Field of Search ..... 248/4, 351, 354 R; 280/179 R, 414; 115/17 R, 41 R

[56] References Cited

U.S. PATENT DOCUMENTS

| | | | |
|---|---|---|---|
| 1,300,154 | 4/1919 | Fouse | 248/354 P |
| 1,500,841 | 7/1924 | Paske | 52/148 |
| 2,977,084 | 3/1961 | Brown et al. | 248/4 X |
| 3,693,576 | 9/1972 | Driscoll | 115/41 R |
| 3,941,344 | 3/1976 | Paterson | 115/17 X |
| 3,952,986 | 4/1976 | Wells | 248/354 R |

*Primary Examiner*—J. Franklin Foss

*Attorney, Agent, or Firm*—Woodard, Weikart, Emhardt & Naughton

[57] ABSTRACT

A motor support apparatus is disclosed herein which comprises a support for an outboard motor when the motor is mounted upon the transom of a boat being transported by a trailer. The support includes a shaft having a bracket for mounting one end of the shaft to the boat trailer. The opposite end of the shaft has a V-shaped motor bracket connected thereto. The support is oriented such that a portion of the motor is received within the V-shaped bracket.

4 Claims, 5 Drawing Figures

TRANSOM SAVER

BACKGROUND OF THE INVENTION

1. Field of the Invention

The present invention relates to a support for an outboard motor mounted upon a boat being transported by a trailer, and more particularly relates to a support of the described type having resilient members for firmly engaging the motor while being minimally affected by the vibratory motion of the motor.

2. Description of the Prior Art

It is known in the prior art to include a support attached to a trailer to reduce the stress upon the transom of the boat when the boat is transported by a trailer, with the motor remaining mounted upon the transom. It is readily understandable that the substantial weight of an outboard motor will transmit considerable stress to the boat transom as the boat is being transported. Of course, the amount of stress applied to the transom will be directly related to the unevenness of the road or other surface over which the boat and trailer are being transported. To overcome this problem, a support has been used in the prior art to directly connect the trailer to the outboard motor during transportation. In this manner, both the boat and the motor are secured to the trailer and the amount of stress applied to the boat transom is minimized.

The motor supports of the prior art have included a shaft which mounts at one end to the boat trailer and which receives a portion of the outboard motor at the other end. Typically, a bracket is connected to one end of the shaft of such a support and the bracket is mounted directly to a portion of the framework of the trailer. A V-shaped motor bracket is connected to the opposite end of the shaft for reception therein of a portion of the outboard motor. A problem which has existed with the devices of the prior art has been the structural failure of the V-shaped bracket utilized by the support. The portion of the outboard motor supported by these supports is the portion which extends downwardly below the surface of the water when the boat is in the water. The propeller and associated elements are located at the extreme end of this portion of the motor. As a result, the supported portion of the motor represents a relatively long member having substantial weight at its end, which can produce considerable forces against the motor bracket. Prior to the present invention, the motor bracket has been molded from a single material such as cast aluminum or plastic. The inability of such material to absorb, without structural failure, the forces transmitted through the supported portion of the motor has proved to be a significant problem with the supports of the prior art. The present invention provides a motor support which includes a V-shaped motor bracket having internal, resilient members encased by a suitable, resilient material. The V-shaped motor bracket of the present invention is capable of withstanding the considerable forces applied by the supported portion of the motor without structural failure.

SUMMARY OF THE INVENTION

A motor support apparatus is described herein for supporting an outboard motor when the motor is mounted upon the transom of a boat transported by the trailer, the apparatus comprising a shaft having a first end and a second end, attachment means for mounting the first end of the shaft on the trailer, a V-shaped motor bracket mounted to the second end of the shaft, the bracket being oriented to receive a portion of the motor therein, the bracket including first and second members having mutually-facing support surfaces disposed at an acute angle, each of the first and second members including a resilient, structural metal member and a material secured to the metal member forming the support surface, and means for retaining the motor within the motor bracket.

It is an object of the present invention to provide a motor support apparatus for supporting an outboard motor when the boat upon which the motor is mounted is transported by a trailer.

Another object of the present invention is to provide a motor support apparatus of the described type which includes a V-shaped motor bracket which will not fail as a result of the forces applied to it by the supported portion of the motor.

It is a further object of the present invention to provide a motor support apparatus as hereinabove described and which includes a motor bracket having resilient, structural metal members which are covered with a material for forming the supporting surface of the bracket.

Further objects and advantages of the present invention will become apparent from the description of the preferred embodiment which follows.

DESCRIPTION OF THE PREFERRED EMBODIMENT

Figure 1:
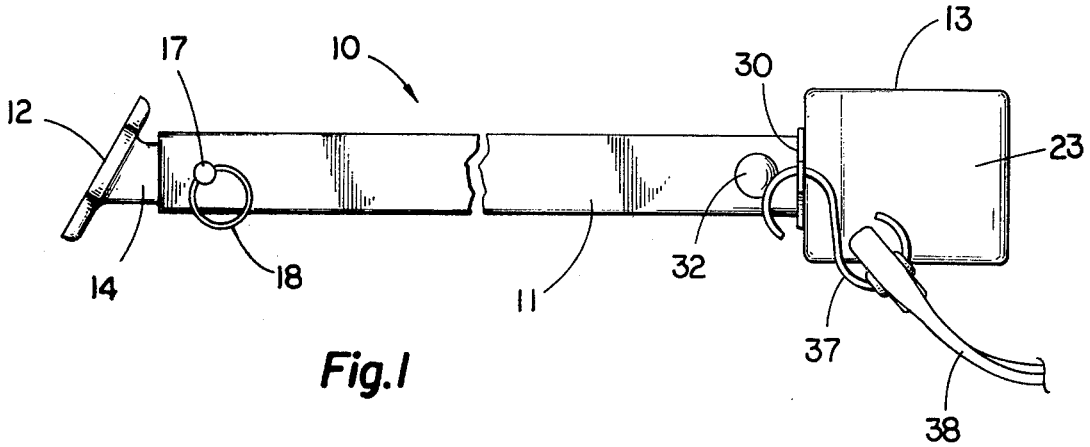
FIG. 1 is a side, elevational view of the motor support apparatus of the present invention.
Figure 2:
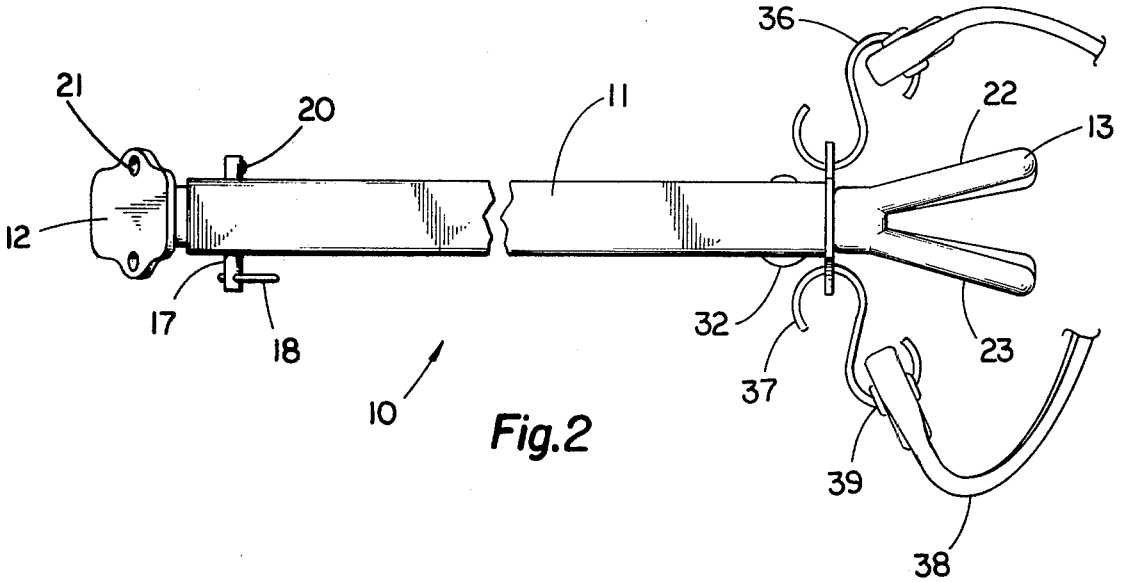
FIG. 2 is a top, plan view of the motor support apparatus of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention provides a motor support apparatus which supports an outboard motor when the motor is mounted upon the transom of a boat being transported by the trailer. Referring in particular to the figures, there is shown the motor support apparatus 10 constructed in accordance with the preferred embodiment of the present invention. Apparatus 10 includes a hollow, square shaft 11 having a mounting bracket 12 secured to one end and a motor bracket 13 secured to the opposite end. Mounting bracket 12 comprises a baseplate from which extends a connecting portion 14 for securement of the mounting bracket 12 to the shaft 11. Portion 14 defines a hole 15 extending therethrough and which is alignable with aligned apertures 16 defined by opposite sides of shaft 11. Portion 14 is received within the hollow interior and a retaining pin 17 extends through apertures 16 and hole 15 to retain portion 14 therein. A pull ring 18 is secured to pin 17 by reception within a diametric hole 19 defined by the pin. A detent ball 20 is positioned at the end of the pin 17 opposite pull ring 18 to normally retain pin 17 within apertures 16 and hole 15. Force exerted to remove pin 17 from the aligned apertures will depress the detent ball 20 sufficiently to permit such removal. In this manner, provision is made for the separation of shaft 11 from mounting bracket 12 when the apparatus 10 is not in use. The baseplate of the mounting bracket 12 defines a pair of apertures 21 through which, for example, bolts may be extended for securement of the mounting bracket to the frame of the trailer.

A V-shaped motor bracket 13 is secured to the end of shaft 11 opposite the mounting bracket 12. Motor bracket 13 comprises members 22 and 23 which define mutually-facing surfaces disposed at an acute angle to one another. As is particularly shown in FIG. 4, a portion of the outboard motor 43 is received between members 22 and 23 and is engaged by the mutually-facing surfaces.

Figure 4:
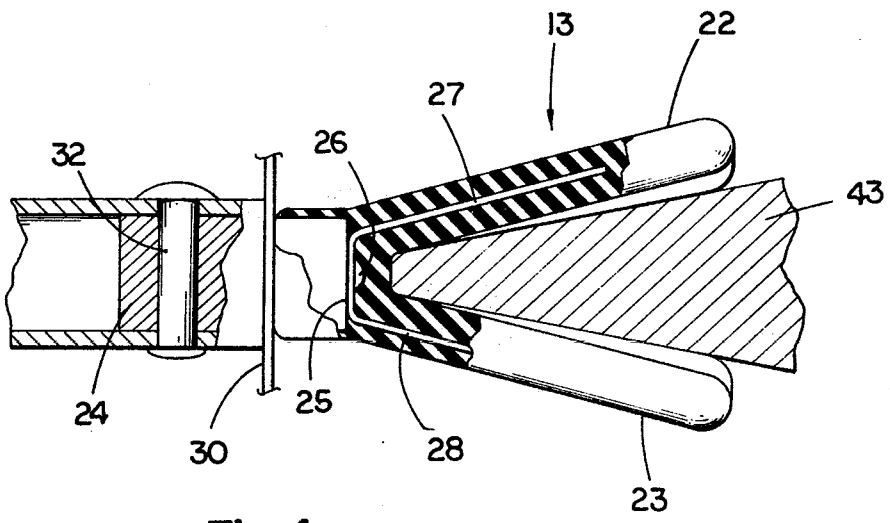
FIG. 4 is a partial, cross-section view of the motor support apparatus of the present invention, showing in particular the reception of a portion of the motor within the motor bracket of the present invention.
Figure 3:
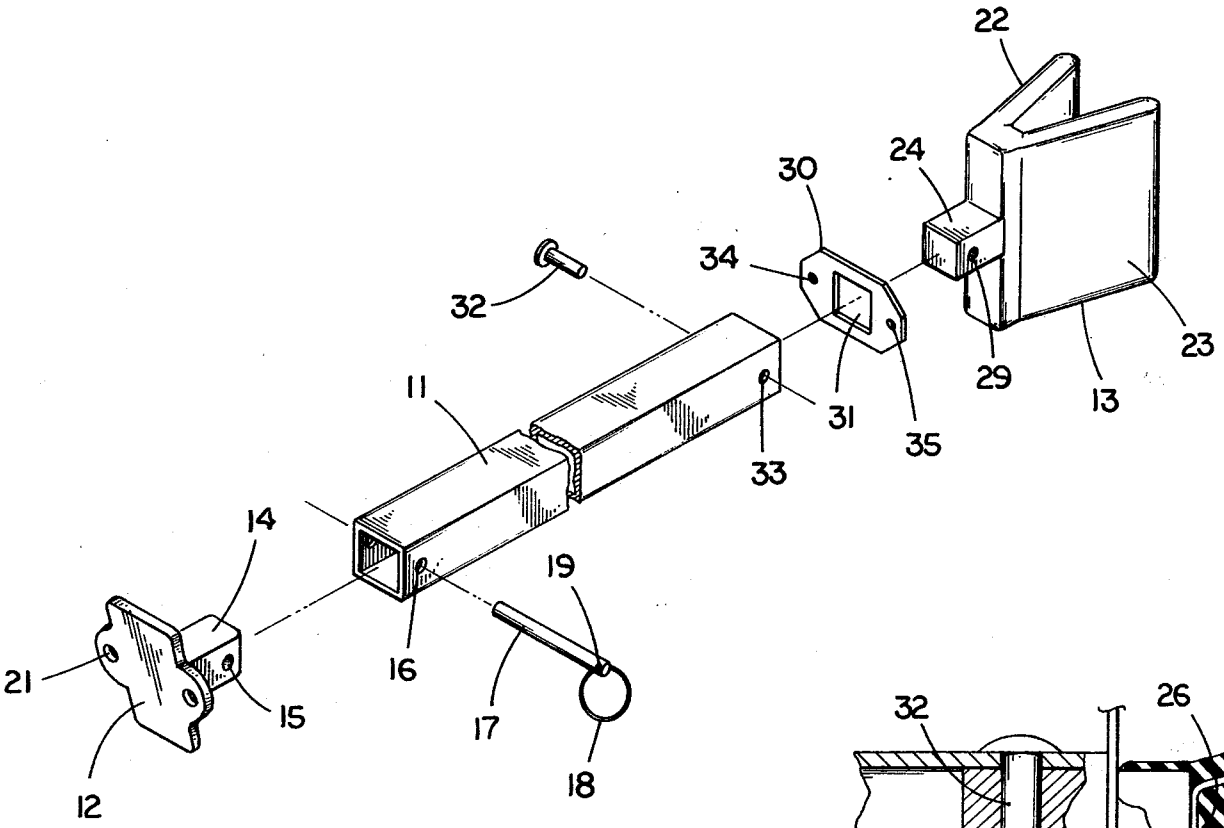
FIG. 3 is an exploded, perspective view of the present invention.

Referring in particular to FIG. 4, it is shown that the motor bracket 13 includes a support block 24 which is received within the hollow interior of shaft 11. Support block 24 defines an aperture 29 which is alignable with aligned apertures 33 defined by shaft 11. Rivet 32 extends through apertures 33 and hole 29 to retain support block 24 within the interior of shaft 11.

Motor bracket 13 further includes a formed, metal member 25 including metal members 27 and 28. Member 25 is secured to support block 24 by rivet 26. Metal members 27 and 28 are structural members which define the orientation of members 22 and 23. The metal members 27 and 28 are resilient in the sense that they are capable of limited deformation with a return to their initial shape. The resiliency of the members 27 and 28 provides a means for frictionally engaging the portion of the outboard motor 43 which is received by the motor bracket 13. Members 27 and 28 are encased with a suitable material such as a soft rubber or plastic; the material forming the mutually-facing surfaces which support and engage the motor 43. The internal metal members 27 and 28 act in cooperation to permit the motor to be received between members 22 and 23 and, if the shape of the supported portion requires, the members 22 and 23 may be flexed outwardly of each other in order to receive the motor therebetween. In this manner, the motor bracket 13 is capable of receiving outboard motors of varying sizes and shapes without structural damage being caused to the motor bracket. In addition, the metal members 27 and 28 are sufficiently resilient that an outward displacement of the members 22 and 23 causes the members to frictionally engage the motor therebetween as the members 27 and 28 are urged to their initial condition.

A plate 30 is also secured to the end of shaft 11 at which the motor bracket 13 is secured. Plate 30 defines a square aperture 31 through which support block 24 extends. Plate 31 is positioned between shaft 11 and motor bracket 13 and is thereby retained in position relative shaft 11 by the securement of motor bracket 13 to shaft 11. Plate 30 defines a pair of apertures 34 and 35 within which S-shaped connectors 36 and 37 are received. Connectors 36 and 37 also extend within apertures 39 defined by retaining strap 38. In use, retaining strap 38 is positioned about the portion of the motor 43 which is received between members 22 and 23 of motor bracket 13. Retainer strap 38 is preferably a strong, elastic member which, when positioned about the supported motor, will firmly retain the motor within the motor bracket 13.

Figure 5:
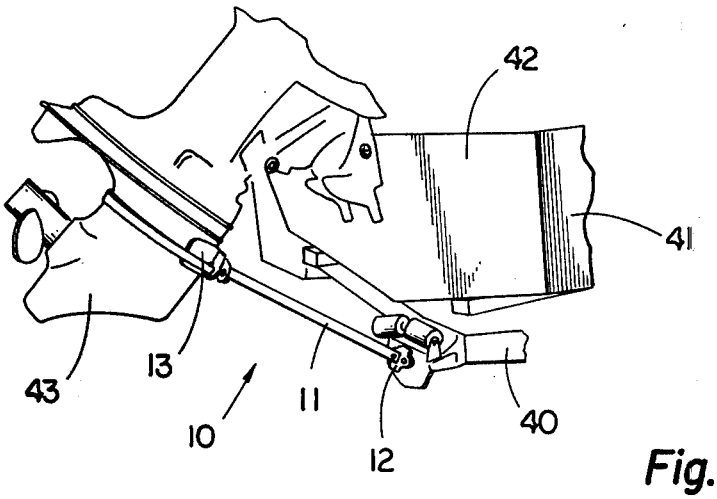
FIG. 5 is a perspective view of the motor support apparatus of the present invention shown mounted upon a trailer and supporting an outboard motor.

Referring in particular to FIG. 5, there is shown the manner in which the motor support apparatus of the present invention is utilized. Mounting bracket 12 secures one end of shaft 11 to the trailer 40. Boat 41 having motor 43 mounted upon the boat transom 42 is supported upon the trailer 40 in the usual fashion. Motor bracket 13 is positioned to receive a portion of motor 43 therein. Apparatus 10 thereby forms a bridge between motor 43 and trailer 40, and minimizes the stresses applied through the motor 43 to the boat transom 42.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A motor support apparatus for supporting an outboard motor when the motor is rotated upon the transom of a boat transported by the trailer, which comprises:

a shaft having a first end and a second end;

attachment means for mounting the first end of said shaft on the trailer;

a V-shaped motor bracket mounted to the second end of said shaft, said bracket being oriented to receive a portion of the motor therein, said bracket including first and second members having mutually facing support surfaces disposed at an acute angle, each of said first and second members including a resilient, structural metal member, and a material secured to the metal member forming the support surface; said motor bracket comprising a generally V-shaped, formed metal component having a base and first and second portions extending therefrom, the resilient, metal members of the first and second members of said motor bracket comprising the first and second portions of the formed component, the first and second portions being flexible outwardly to receive motors of varying sizes therebetween.

2. The apparatus of claim 1 in which the shaft defines a hollow interior, said motor bracket including a support block, the base of said formed component being mounted to the support block, the support block being received within the interior of said shaft.

3. The apparatus of claim 2 in which said means for retaining the motor within said motor bracket includes a plate connected to said shaft, the plate defining a central aperture, the support block of said motor bracket extending through the central aperture of the plate, whereby the plate is secured to said shaft by said motor bracket.

4. The apparatus of claim 3 in which the plate of said retaining means defines second and third apertures, said retaining means further including a retainer strap and connectors secured to opposite ends of the strap, the connectors being received within the second and third apertures defined by the plate.

* * * * *